US005219162A

United States Patent [19]

Orbanes et al.

[11] Patent Number: 5,219,162

[45] Date of Patent: Jun. 15, 1993

[54] TOY BALL AND METHOD OF MAKING IT

[75] Inventors: Philip E. Orbanes, Topsfield; Edward G. Margolis, Beverly, both of Mass.; Henry Delach, Bethpage, N.Y.

[73] Assignee: Marvlee, Inc., New York, N.Y.

[21] Appl. No.: 894,558

[22] Filed: Jun. 15, 1992

Related U.S. Application Data

[62] Division of Ser. No. 779,842, Oct. 21, 1991, Pat. No. 5,161,798.

[51] Int. Cl.[5] ..... A63B 45/00

[52] U.S. Cl. ..... 273/58 E; 273/65 ED; 446/409

[58] Field of Search ..... 273/58 R, 58 A, 58 B, 273/58 BA, 58 E, 58 F, DIG. 20, 65 EC, 65 EE; 446/409, 419

[56] References Cited

U.S. PATENT DOCUMENTS

| | | | |
|---|---|---|---|
| 996,458 | 6/1911 | Coleman | 273/DIG. 20 |
| 2,003,957 | 6/1935 | Salisbury | 273/58 E |
| 3,395,462 | 8/1968 | Sebree | 273/58 E |
| 4,194,737 | 3/1980 | Farmer | 273/58 F |
| 4,278,248 | 7/1981 | Kifferstein | 446/419 |

FOREIGN PATENT DOCUMENTS

| | | | |
|---|---|---|---|
| 0502307 | 7/1930 | Fed. Rep. of Germany | 273/58 R |
| 0914353 | 7/1954 | Fed. Rep. of Germany | 273/58 F |

*Primary Examiner*—V. Millin
*Assistant Examiner*—Steven B. Wong
*Attorney, Agent, or Firm*—Fiddler Levine & Mandelbaum

[57] ABSTRACT

A toy ball having a solid body of foam plastic material and a noisemaker completely embedded within the foam plastic body. The noise maker includes a hollow rigid housing, which may be formed of a hard plastic, and a marble within the housing free to roll around therein so as to create a clattering sound when the ball is shaken, thrown, and caught. The internal surface of the housing has inwardly-projecting ridges to enhance the clatter produced as the marble, which may be a steel ball, rolls around within the housing. The foam plastic body of the ball is made in a mold cavity having the shape of the ball to be produced. While the mold is open, the noisemaker is resiliently suspended along the centerline of the mold cavity so that the center of the noisemaker substantially coincides with the midpoint of the mold cavity centerline. Plastic material is placed within the mold cavity, the mold is closed, and the plastic foam expands to fill the mold cavity, at the same time completely surrounding the noisemaker. The noisemaker is initially suspended by tying it to two opposite ends of one of the mold parts, while the mold is open, such as by using strings attached to the mold positioning pins. On one side of the noisemaker, the tie includes a spring stretchable in the longitudinal direction of the tie. The spring maintains the tying arrangement taut so that the noisemaker does not sag out of its position when its center is coincident with the midpoint of the centerline of the mold cavity.

8 Claims, 2 Drawing Sheets

FIG. 4
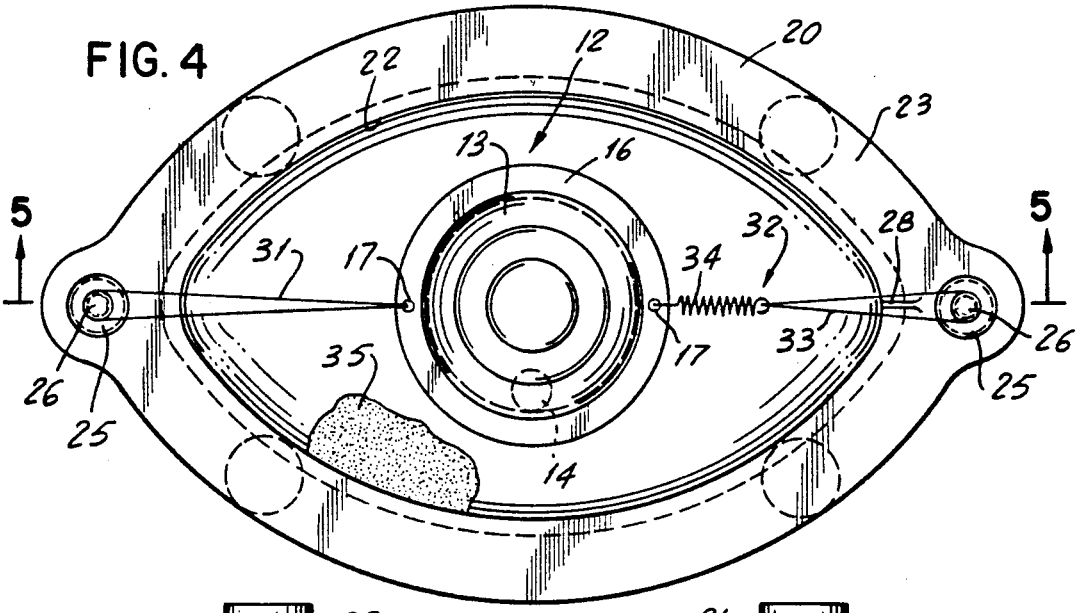
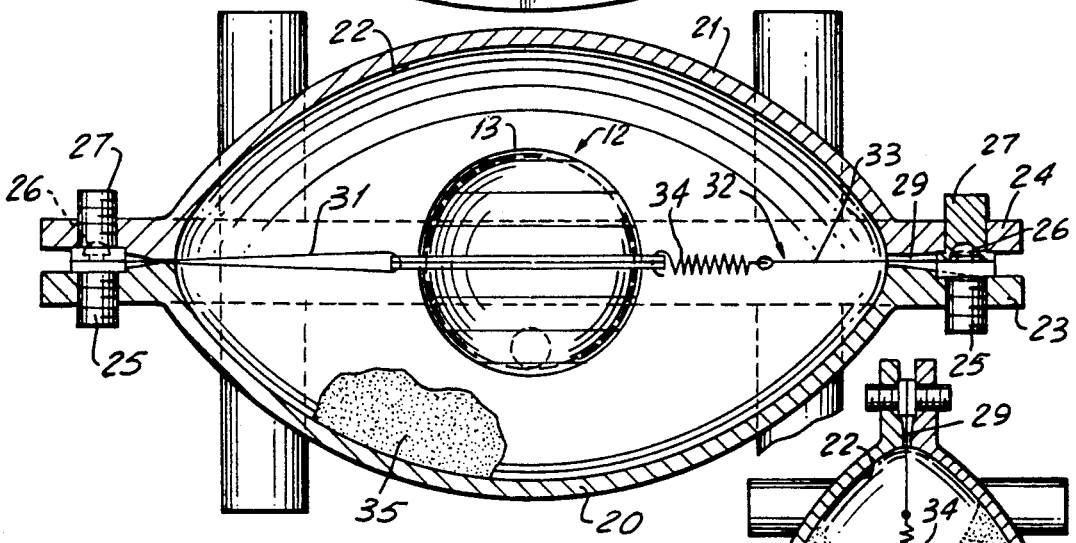
FIG. 5
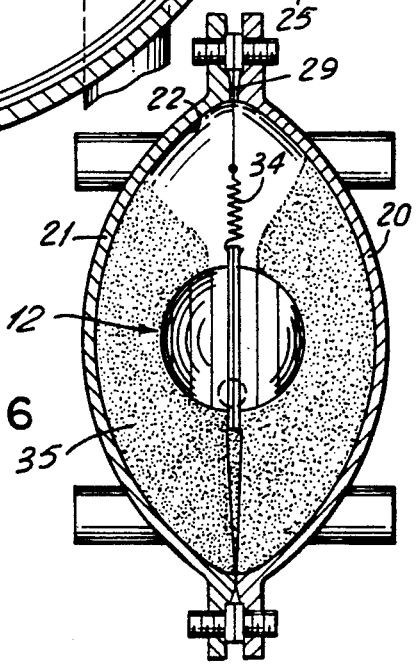
FIG. 6

TOY BALL AND METHOD OF MAKING IT

This application is a division of application Ser. No. 779,842, filed Oct. 21, 1991 now U.S. Pat. No. 5,161,798.

This invention relates to toy balls, such as those formed of foam plastic, and more particularly to such a ball incorporating an internal noisemaker.

Toy balls made of foam plastic are known, and have the benefit of being softer and lighter in weight than comparable balls made of other materials. The softness of the ball reduces the possibility of injury to children playing with it, and its light weight makes it easier for young children to throw and kick the ball.

Toy balls incorporating internal noisemakers are also known. U.S. Pat. No. 2,003,957 shows a rubber ball having an internal cavity, the cavity being defined by a number of flat faces arranged at angles to each other. Within the cavity is a bell which tumbles around a the ball moves and produces a sound. So as to permit insertion of the bell into the cavity, the ball is molded with a relatively large opening between its outer surface and the internal cavity. A plug is then inserted into the opening to close it. This procedure is rather expensive, and leaves the ball with an unsightly seam between the plug and the remainder of the ball body.

U.S. Pat. No. 1,668,143 shows a thin-walled hollow rubber ball having a bell within it. As the ball moves, the bell rolls around and produces a sound. This ball is not of the type formed of foam plastic or foam rubber.

U.S. Pat. No. 4,448,418 shows a hollow ball containing a "fluid" material, such as lead shot. In one embodiment, shown in FIG. 4 of the patent, the ball has a thick wall of sponge rubber. However, the interior fluid material in not intended to make noise. Instead, its purpose is to cause the ball to stop "dead" when it is thrown. U.S. Pat. No. 5,000,451 shows a toy football formed of foam rubber, having two tubular rings around its girth. Within the tubular rings is a "fluid" material, such as a series of weighted beads or marbles. The purpose of the marbles within the tubular rings is not to produce sound, but rather to add stability to the ball as it is thrown.

U.S. Pat. No. 2,499,483 shows a hollow ball, formed of non-foam plastic, containing several balls within it, the interior balls causing the toy to produce a noise when the ball is shaken.

It is a general object of the present invention to provide a toy having a solid body of foam plastic material, the solid body incorporating within it a noisemaker which produces a clattering sound when the ball is shaken, thrown, and caught.

It is another object of the invention to provide such a ball wherein the noisemaker is located within the ball body s that the center of the ball and the center of the noisemaker are substantially coincident whereby the presence of the noisemaker within the ball does not destabilize the ball when it is thrown or kicked.

A feature of the invention is employing a noisemaker comprising a hollow rigid housing, preferably a sphere of hard plastic material, and a marble, such as a steel ball, within the housing and free to roll around therein so as to create the clattering sound. The symmetry of the noisemaker housing, and its location at the center of the ball body, insure that the presence of the noisemaker will not cause the ball to wobble or otherwise behave in a destabilized manner when in use.

A further object of the invention is to provide a method of making a foam plastic toy ball having and internal noisemaker, so that the noisemaker is located at the internal center of the ball body. For this purpose, the invention contemplates resiliently suspending the noisemaker along the centerline of the open mold cavity, the resilient suspension preventing the noisemaker from sagging out of its desired position at the center of the mold cavity prior to the time that the foam plastic, which expands to form the ball body, encapsulates the noisemaker.

It is still another object of the invention to utilize the conventional positioning pins, carried by one of the two mold parts which define the cavity, as the anchors to which the ties, which suspend the noisemaker within the cavity, are attached.

Additional objects and features of the invention will be apparent from the following description, in which reference is made to the accompanying drawings.

In the drawings:

FIG. 4 is a face view of one of the two mold parts which together define the mold cavity within which the ball is molded, the noisemaker being resiliently suspended within the cavity;

FIG. 5 is a longitudinal cross-sectional view of the closed mold, as seen along line 5—5 of FIG. 4; and FIG. 6 is a view similar to FIG. 5, on a smaller scale, showing the foam plastic within the mold cavity expanding to form the toy ball body.

Figure 1:
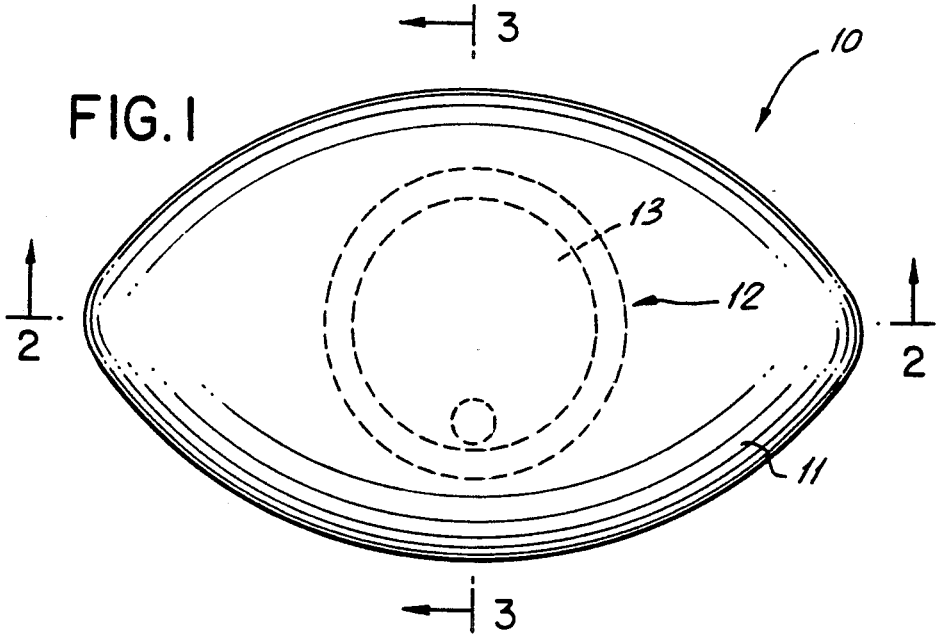
FIG. 1 is a side elevational view of a toy football according to the present invention.
Figure 2:
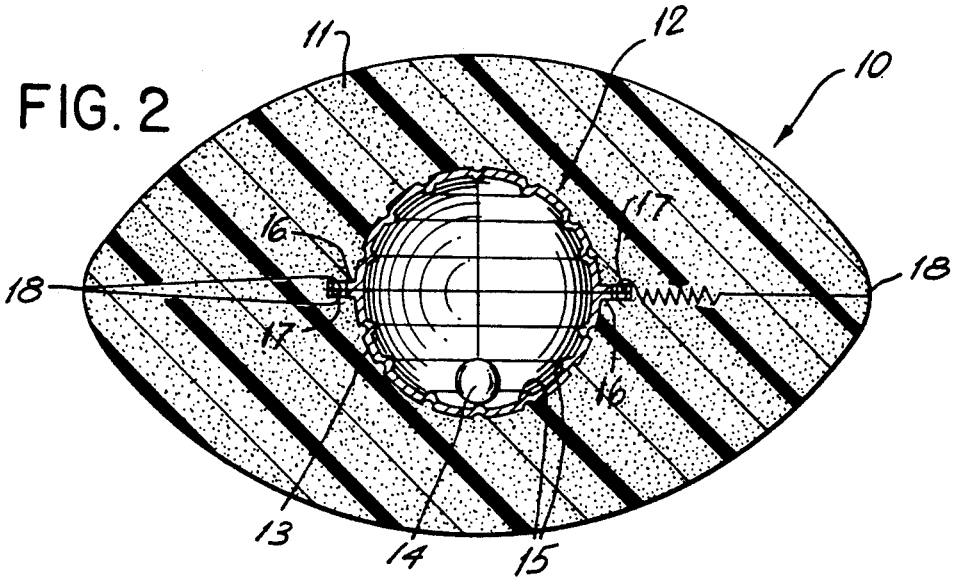
FIG. 2 is a longitudinal cross-sectional view of the toy football taken along line 2—2 of FIG. 1.
Figure 3:
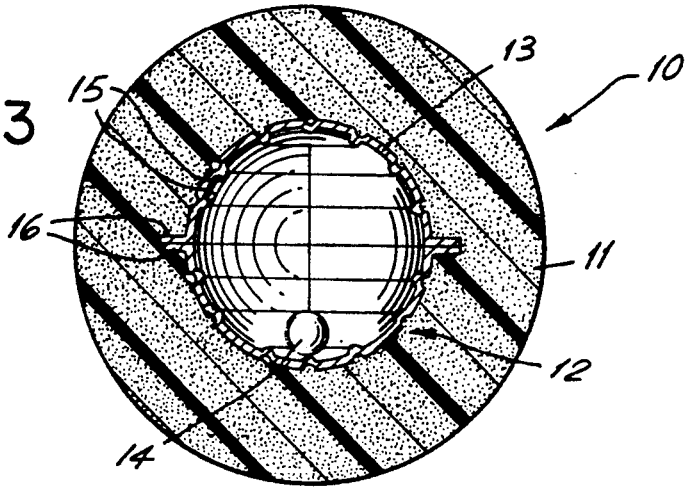
FIG. 3 is a lateral cross-sectional view taken along line 3—3 of FIG. 1.

The toy ball chosen to illustrate the present invention, and shown in FIGS. 1-3, is a toy football. It is to be understood, however, that other types of balls are included within the scope of the present invention, such as, baseballs, softballs, and soccer balls.

The toy football 10 includes a solid body 11 formed of a suitable, conventional foam plastic material, such as polyurethane. Embedded within the foam plastic body 11 is a noisemaker 12. In the present example, the noisemaker comprises a spherical, hollow rigid housing 13, preferably formed of a hard plastic, such as styrene. Within housing 13 is a marble 14, preferably a steel ball. As shown, the diameter of the marble is at least several times smaller than the internal diameter of the housing, so that the marble is free to roll and bounce around within the housing 13 so as to create a clattering sound.

The internal surface of housing 12 is formed with inwardly-projecting ridges 15 which increase the bouncing of marble 14 and thereby enhance the clatter produced as the marble moves around within the housing.

Housing 13 is formed of two identical halves, the circular edge of each half terminating in an outwardly-projecting annular flange 16. After marble 14 is inserted into one of the halves, the two halves are joined together, such as by adhesively bonding the flanges 16. The flanges are formed with two diametrically opposite holes 17. As will be more fully described later, holes 17 are used to accommodate ties which are employed to suspend the noisemaker 12 within the mold cavity used to produce the toy ball body.

An important feature of the invention is that the center of ball body 11 and the center of housing 13 are substantially coincident, so that the presence of noisemaker 12 within the ball body does not cause the ball to be weighted eccentrically, which would produce wobbling and unstable behavior when the ball is thrown or kicked. The "center" of the ball body 11 is intended to refer to the midpoint of the center-line drawn between the two ends 18 of the body. The "center" of the noisemaker 12 refers to the center of the spherical housing 13.

The foam plastic body of the toy football according to the present invention is molded in a generally conventional manner, illustrated in FIGS. 4–6. What is not conventional is the way in which the noisemaker 12 is retained within the mold prior to the molding operation.

A two part mold is employed, including what will be referred to as a bottom part 20 and a top part 21, since this is the orientation of the mold parts shown in FIG. 5. When the mold is closed, i.e. the two mold parts are brought together as shown in FIG. 5, they define between them a mold cavity 22 having the shape of the toy ball body 11 to be produced. The two mold parts 20 and 21 are substantially identical, so that each contains one half of the mold cavity 22.

The mold parts 20 and 21 have outwardly projecting flanges 23 and 24, respectively, the flanges being in registry when the mold is closed. Flange 23 carries two dowels 25, at either end, and a positioning pin 26 is presented on the upper face of each dowel 25. Flange 24 of mold part 21 carries two dowels 27 at its opposite ends, each dowel having a positioning recess in its lower surface. When the two mold parts are brought together to close the mold, the positioning recesses in dowels 27 accommodate the positioning pins 26 to insure that the two mold parts are properly positioned with respect to each other. Each of the flanges 23 and 24 is formed with a vent groove 28 (FIG. 4), so that when the mold is closed, a vent hole 29 extends through the flanges between mold cavity 22 and the atmosphere.

At the beginning of the molding operation, the mold is open, i.e., mold parts 20 and 21 are separated. Thus, in FIG. 4, only the lower mold part 20 is shown, the upper mold part 21 having been removed from the lower mold part. Noisemaker 12 is resiliently suspended on mold part 20. In the present example, two ties 31 and 32 are employed to attach noisemaker 12 to the two positioning pins 26. Tie 31 includes a loop of string extending through one of the holes 17 in flange 16 of the noisemaker and around the left positioning pin 26 (as viewed in FIG. 4). The string may be of any suitable material, but preferably is of a natural or man-made fiber.

Tie 32 includes a similar string 33 looped around the right positioning pin 26 (as viewed in FIG. 4). String 32 also engages one end of a coil spring 34, the other end of which extends through one of the holes 17 in the flange 16 of noisemaker 12. It will be seen that spring 34 is stretchable in the longitudinal direction of tie 32. The lengths of strings 31 and 32, and spring 34, are chosen so that when strings 31 and 32 are looped around their respective positioning pins 26, and spring 34 is tensioned, the center of spherical noisemaker housing 13 is substantially coincident with the midpoint of the mold cavity centerline extending between positioning pins 26. In this position, the noisemaker will be in the physical center of the ball to be molded.

After noisemaker 12 has been positioned on mold part 20, as described above, a quantity of foamable plastic 35 is placed in the cavity of mold part 20. Thereafter, the mold is closed, as shown in FIG. 4. The mold is then rotated 90°, to the position shown in FIG. 6, so that vent hole 29 is located at the top of the mold. Either chemically, or as a result of heat, plastic 35 foams and expands within mold cavity 22, and as it expands it pushes the air within the mold cavity out through vent hole 29. Expansion of the plastic also causes it to completely surround noisemaker 12 and fill mold cavity 22, so as form the solid foam plastic body 11 of toy ball 10. Depending upon the composition and quantity of plastic 35 placed in the mold, the toy ball body will be more or less dense when molding has been completed.

The importance of utilizing spring 34 in the ties which hold noisemaker 12 in place is that the tension in spring 34 keeps ties 31 and 32 taught, and hence prevents noisemaker 12 from sagging out of its desired position at the center of the mold cavity prior to the time that plastic 35 expands to fill the mold cavity. In this way, there is assurance that in the finished toy ball, the center of noisemaker 12 will be substantially coincident with the center of the toy ball body 11. In the absence of spring 34, there is no way of assuring that ties 31 and 32 will hold noisemaker 12 in the desired location while the mold is closed and the foaming of plastic 35 takes place.

The invention has been shown and described in preferred form only, and by way of example, and many variations may be made in the invention which will still be comprised within its spirit. It is understood, therefore, that the invention is not limited to any specific form or embodiment except insofar as such limitations are included in the appended claims.

We claim:

1. A toy ball comprising:

a body of foam plastic material, solid except for a chamber centered therewithin, a hollow rigid housing completely embedded within the foam plastic body and filling the chamber whereby relative movement between the body and housing is prevented, and a marble having a diameter less than half the smallest internal diameter of the housing within the housing and free to roll and bounce around therein for multidimensional movement so as to create a clattering sound when the ball is shaken, thrown, and caught.

2. A toy ball as defined in claim 1 wherein the foam plastic forming the body has been molded around the housing.

3. A toy ball as defined in claim 1 wherein the diameter of the marble is at least several times smaller than the internal diameter of the housing.

4. A toy ball as defined in claim 1 wherein the housing is formed of a hard, rigid plastic.

5. A toy ball as defined in claim 4 wherein the marble is a solid metal sphere.

6. A toy ball as defined in claim 1 wherein the housing is spherical.

7. A toy ball as defined in claim 1 wherein the internal surface of the housing has inwardly-projecting ridges to enhance the clatter produced as the marble rolls around within the housing.

8. A toy ball as defined in claim 1 wherein the center of the ball and the center of the housing are substantially coincident.

* * * * *